US005690214A

United States Patent [19]

Gaines et al.

[11] Patent Number: 5,690,214

[45] Date of Patent: Nov. 25, 1997

[54] TOOTHBRUSH STORAGE DEVICE

[75] Inventors: Dennis Morgan Gaines; Brenda Lynn Bjelan, both of Brantford, Canada

[73] Assignee: Innoversions International Inc., Canada

[21] Appl. No.: 703,375

[22] Filed: Aug. 26, 1996

[51] Int. Cl.[6] ..... B65D 83/10

[52] U.S. Cl. ..... 206/209.1; 206/369; 206/362.1; 206/362.3; 206/15.3; 422/300

[58] Field of Search ..... 206/209, 209.1, 206/361, 362, 362.2, 362.3, 369, 15.2, 15.3; 422/300; 132/308, 310

[56] References Cited

U.S. PATENT DOCUMENTS

| | | | |
|---|---|---|---|
| 1,278,789 | 9/1918 | Thompson | 422/300 |
| 2,302,698 | 11/1942 | Kessel | 422/300 |
| 2,457,500 | 12/1948 | Scandura | 422/300 |
| 3,727,748 | 4/1973 | Brown | 206/362.1 |
| 3,881,868 | 5/1975 | Duke | 206/209.1 |
| 4,050,894 | 9/1977 | Genis | 206/369 |
| 4,473,152 | 9/1984 | Jump, Jr. et al. | 206/209.1 |
| 4,585,119 | 4/1986 | Boyington | 206/209.1 |
| 4,915,219 | 4/1990 | Ottimo | 206/209.1 |
| 4,978,003 | 12/1990 | Fostet | 206/362 |
| 4,995,509 | 2/1991 | Kornfeind | 206/362 |
| 5,086,916 | 2/1992 | Gray | 206/209.1 |
| 5,107,987 | 4/1992 | Palazzolo et al. | 206/209.1 |
| 5,377,824 | 1/1995 | Seymour | 206/209.1 |
| 5,566,823 | 10/1996 | Summers | 206/362.2 |

*Primary Examiner*—David T. Fidei
*Attorney, Agent, or Firm*—Edward H. Oldham

[57] ABSTRACT

A device that stores and sanitizes toothbrushes in individual storage pockets in a vessel containing a sanitizing solution. Each storage pocket is formed in the top surface of the vessel in such a manner that the storage pocket is partially filled with sanitizing solution and in normal use, the pocket is sealed from the sanitizing fluid contained in the main vessel. When the sanitizing solution has served its useful life in the pockets of the vessel, the vessel is overturned, the used sanitizing liquid in each of the pockets is dumped out by over-turning the vessel. The vessel is then returned to its normal orientation, and the top of the vessel is raised slightly to allow the top of each pocket to slightly separate from the lower portion of each pocket to allow the sanitizing liquid in the vessel to flow into each pocket to replenish the sanitizing fluid in each pocket. When each pocket is filled to the desired level, the top of the vessel is returned to its sealing position and locked in this position until the solution in the pockets is spent.

6 Claims, 2 Drawing Sheets

TOOTHBRUSH STORAGE DEVICE

BACKGROUND OF THE INVENTION

1. Field of the Invention

This invention relates to a device for sanitizing toothbrushes when not in use. More particularly, this invention relates to a vessel having multiple toothbrush receptacles formed therein for receiving a single toothbrush in each of the receptacles, such that each receptacle is isolated from each other and from the fresh unused sanitizing solution contained in the vessel. Each of the individual receptacles of the vessel is identifiable by number or colour and the interior of the vessel is accessible by removal of the top portion to allow the sanitizing solution to be replenished.

2. Description of the Prior Art

Most toothbrushes are used twice daily and in the periods of non-use, the toothbrush is stored in a rack, or in a receptacle such as a glass tumbler, etc. located in the bathroom where the toothbrush is generally used.

The use of the toothbrush is simple: the brush is removed from its storage container or rack, rinsed in water under a tap, the bristles thereof covered with a cleansing agent and the brush is inserted into the mouth of the user and the teeth and gums are brushed with the covered bristles until the teeth have been deemed to have been cleaned. The toothbrush is again rinsed under the tap with fresh water until the user is satisfied that the brush has achieved the desired degree of cleanliness and the brush is returned to the rack or its storage container.

Because the toothbrush is returned to its storage container in a wet condition where it is uncovered and open to atmosphere, it is possible that any food particles remaining in the brush head may serve as a culture for the promotion of growth of moulds and bacteria.

It is therefore seen that the inclusion of the food particles remaining in the brush after use from the mouth of the toothbrush user are almost impossible to eliminate, despite the best efforts of the user to rinse and clean the toothbrush after each use, the present method of storage provides one of the most unsanitary storage conditions imaginable for the toothbrush. Although this unsanitary storage condition has long been recognized by the prior art, most solutions fall short of preventing the growth of moulds and bacteria in the contaminated brush. For instance, see U.S. Pat. Nos. 5,377,824 issued Jan. 3, 1995; 5,107,987 issued Apr. 28, 1992; 5,086,916 issued Feb. 11, 1992; 4,995,509 issued Feb. 26, 1991; 4,915,219 issued Apr. 10, 1990; 4,585,119 issued Apr. 29, 1986; and 4,473,152 issued Sep. 25, 1984.

SUMMARY OF THE INVENTION

According to this invention, a toothbrush is stored in a separate storage receptacle in a vessel which compartment contains a sanitizing solution which may be emptied and replenished by the user, when the user has determined that the solution in the receptacle has lost its sanitizing capability.

The storage vessel provides a reservoir of fresh sanitizing solution, the interior of which is accessible to the toothbrush user for periodically filing the interior of the vessel with a sanitizing solution to a predetermined level. Access to the interior is then closed off and the receptacles are opened to the interior of the vessel to allow fresh sanitizing liquid to simultaneously enter each receptacle. Control of the inflow of sanitizing solution into each receptacle is maintained by the toothbrush user so that only a certain predetermined amount of sanitizing solution is allowed to enter each receptacle from the interior of the storage vessel during the receptacle refill operation.

When the user has determined that the sanitizing power of the solution contained in each receptacle is spent, the entire vessel is inverted so as to allow each receptacle to be emptied whilst simultaneously restraining the stored sanitizing solution in the interior of the vessel from leaving the vessel, and the vessel is subsequently returned to its "normal" position and the user repeats the process of refilling the receptacles from the sanitizing solution in the main vessel.

Contamination of the sanitizing fluid of the main vessel by any debris left in the emptied receptacles is prevented by assuring that the sanitizing solution always exerts a positive pressure on the receptacle entrance orifices.

The vessel is composed of two parts, a container portion and a lid portion which fit together to form a sealed container. The lid portion contains a plurality toothbrush receptacles where a toothbrush may be inserted. The receptacles which are shown here have been depicted as cylinders, the lower portions of which are tapered to fit into the complimentary tapered depressions in the bottom of the vessel. (Of course, other shapes are possible for the receptacles, i.e. elliptical or rectangular). The lid is clamped to the vessel so that the tapered ends of the receptacle cylinders fit into the complimentary tapered depressions in a sealed manner.

In the receptacle filing operation, the lid portion is unclamped and lifted slightly to allow the lid portion of the vessel and the container portion to separate slightly. This allows the tapered receptacles contained in the lid portion to slightly separate to allow the solution in the container portion of the vessel to flow past the openings in the now slightly displaced mating tapered sections of the receptacles and their mating depressions into the receptacles formed by the lid and the container portions of the vessel. When sufficient solution has entered the receptacles, the lid is reclamped to the container portion of the vessel.

DESCRIPTION OF THE PREFERRED EMBODIMENT

Figure 1:
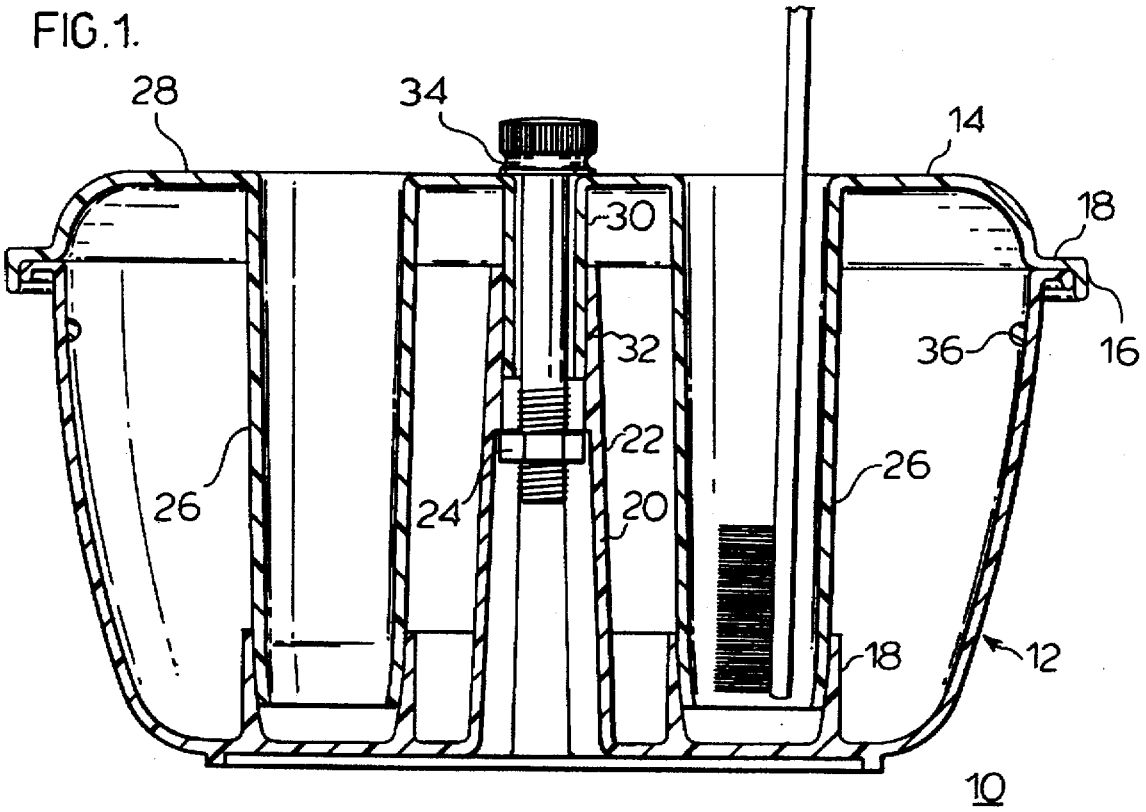
FIG. 1 shows a sectional view of the device of this invention.
Figure 2:
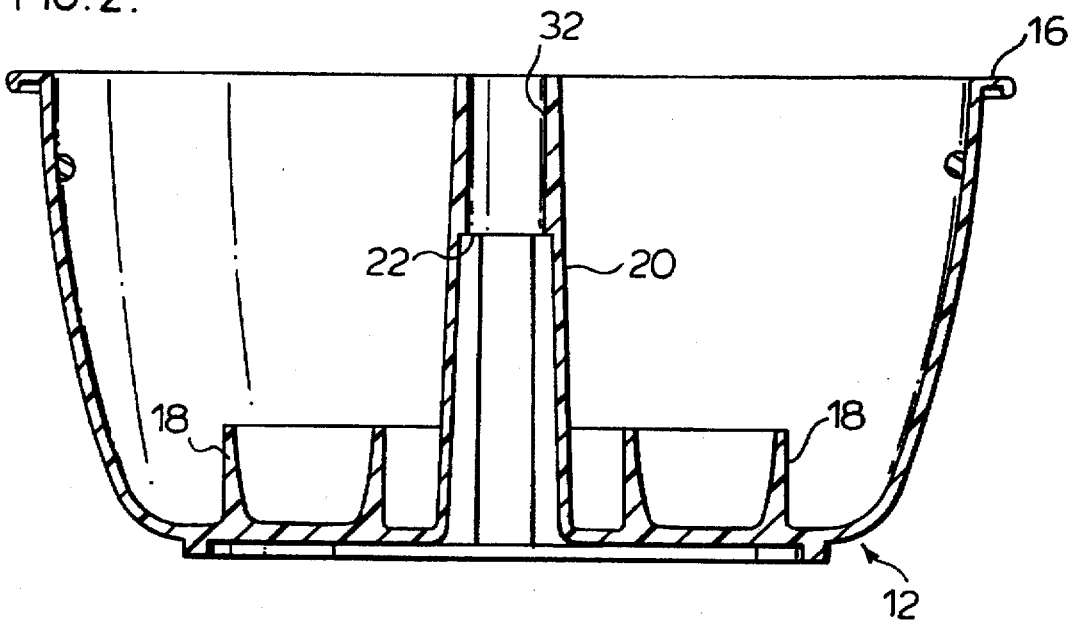
FIG. 2 shows a sectional view of the top portion of the device of FIG. 1.

Referring now to FIG. 1, a vessel 10 is shown having a base portion 12 which serves as a container for the sanitizing solution, and a lid portion 14. The base portion 12 and the lid 14 are composed preferably of a high impact plastic material such as polypropylene, polycarbonate, etc. The base 12 has the general shape of a bowl (see FIG. 2), such that a sealing lip 16 is formed at the top thereof for mating with a complimentary lip 18 on lid 14. Base 12 has a series of shallow cup shaped depressions 18 integrally formed near the bottom thereof.

In the center of the bowl 12 a hollow post 20 is formed therein. Post 20 is integrally formed in the lower surface of base 12 and preferably rises to a height of lip 16. Post 20 is provided with a shoulder 22 on the interior thereof for the provision of providing a bearing surface for nut 24.

Figure 3:
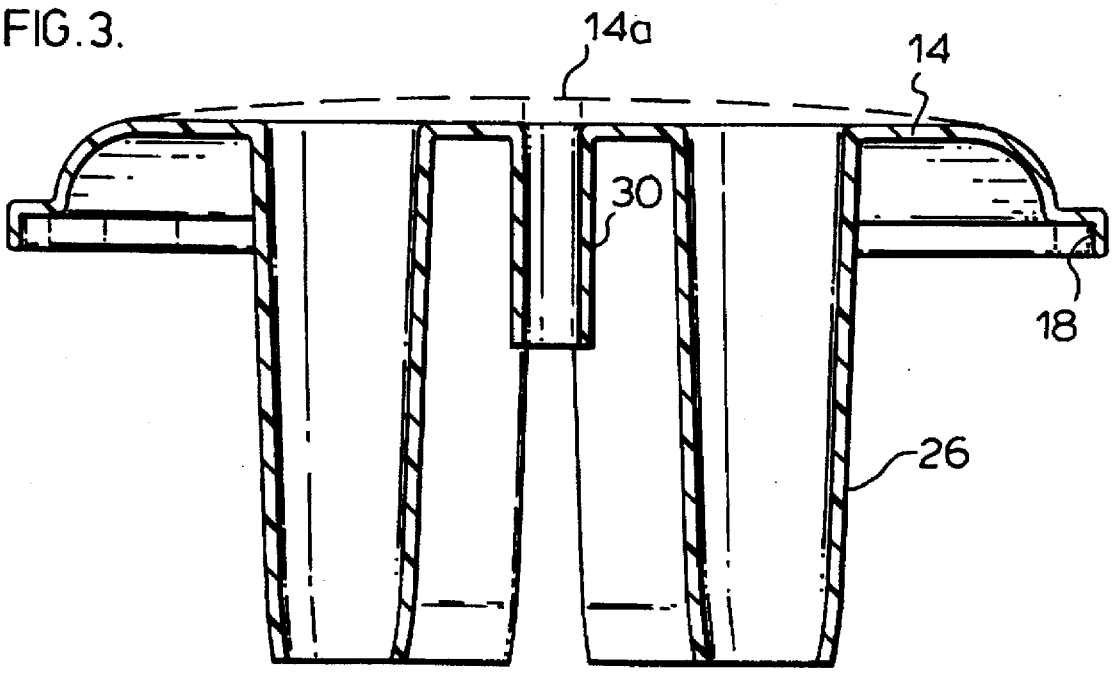
FIG. 3 is a sectional view of the lower portion of the device of FIG. 1.

The lid portion 14 of the vessel 10 is also circular so that lip 18 mates with lip 16 of the container portion of vessel 10 (see FIG. 3). A series of cylinders (slightly tapered) 26 extend downwardly from top surface 28 of lid 14. The tapered cylinders 26 are provided mate with cups 18 so as to provide a liquid seal where the tapered surfaces of the cylinders 26 meet and mate with cups 18. A central post 30 is integrally formed in the center of top surface 28 of lid 14 to mate with post 20 of container 12. (Both posts 20 and 30 have complimentary tapers).

Post 30 is tapered so as to aid in the assembly of the lid 14 with base 12 when the two parts are mated together.

A thumbscrew 34 is provided to hold the assembly 10 together when assembled into a working unit. Thumbscrew 10 passes through post 30 and into post 20. A nut is fed up through post 20 where it mates with thumbscrew 34 and rests against shoulder 22 in the final assembled position.

The lid 14 is designed such that the top surface of the lid 14 is slightly convex when it leaves the mould. This is shown as surface 14*a* in FIG. 3. When in the assembled state as shown in FIG. 1, the compressive force of thumbscrew 34 will cause the top surface of lid 14 to become essentially flat.

In operation, the device functions as follows:

Thumbscrew 34 is removed from its "home" position in lid 14 to permit the lid 14 to be removed from base container 12. The base container 12 is then filled to a predetermined level as indicated by a mark or a ring such as 36 on the interior of the base container 12 placed by the manufacturer for guidance of the user in the filling procedure. When the desired amount of sanitizing solution has been added to base container 12, the lid 14 is returned to the base, so that the cylinders 26 mate with the tapered cups 18. When the user has now aligned the cylinders 26 with the cups 18, thumbscrew 34 is threaded into nut 24 and tightened to cause the lip 18 to engage with lip 16 and as pressure is applied to the lid 14, the curved upper surface 14*a* is now flattened to that shown as 14.

It is in this assembled position that the user may now make use of this sanitizing device. Usually, when the device 10 is being assembled just after filling or replenishing the sanitizing solution in base container 12, stoppers may be placed in the apertures of the tops of cylinders 26 to form an air lock for each cylinder, so that the receptacles are not over filled during the initial assembly operation.

Figure 4:
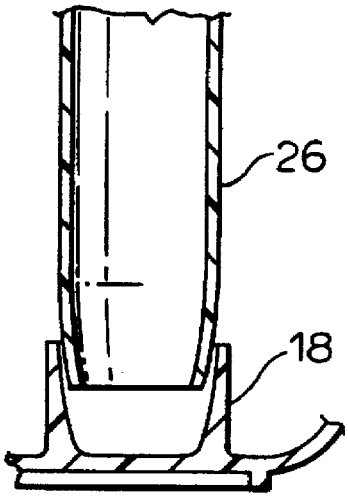
FIG. 4 is a view of the tube-cup interface.

When the lid portion 14 is assembled onto the base container 12, the airlocks provided by the stoppers will prevent the sanitizing solution from entering the cylinders during assembly and mating with cup depression members 18. When thumbscrew 34 has been tightened, the tapered lower surfaces of cylinders 26 now mate with cups 18 to form a liquid tight seal. If stoppers have been applied to the apertures in the top of cylinders 26, the sanitizing solution will be at the approximate height of the tops of the cups 18. To fill the device 10, one removes the stoppers from the tops of the receptacles and simply slackens the thumbscrew 34 and allows the lid 14 to spring upwardly to the unloaded convex position shown in FIG. 3 as 14*a*. In this position, the lower ends of cylinders 26 are slightly retracted from their sealing position (see FIG. 4). This allows the sanitizing solution to slowly enter the cylinders 26 of lid 14. When the desired level of sanitizing solution has been reached, thumbscrew 34 is tightened to force the lower ends of cylinders 26 into a sealing engagement with cups 18. Toothbrushes may now be stored in the sanitizing solution contained in the container formed by cylinders 26 and cup depression members 18.

When the strength of the sanitizing solution is deemed to have been spent, replenishment is as follows:

The vessel 10 (with the lid 14 securely held in place by thumbscrew 34) is inverted over a sink or other container to allow the cylinders 26 to empty. The two lips 16 and 18 seal to prevent the solution from leaking out and the tapered posts 20 and 30 prevent leakage when thumbscrew 34 holds these parts in their "home" position. When the cylinders are drained sufficiently, they can be rinsed with water to assure that all debris has been removed from the various storage chambers formed by cylinders 26 and cups 18, and after sufficient draining of the rinse product therefrom, the device 10 is returned to its normal position with base 12 resting on a flat surface and thumbscrew 34 is loosened to again allow cylinders 26 to retract from their sealing position in cups 18 and again the sanitizing solution is allowed to fill the cylinders 26 to the desired level. When the desired level has been reached, the thumbscrew 34 is tightened to seal the cylinders 26 in cups 18. Use continues until the sanitizing solution must be replenished in base container 12.

It is expected that the various toothbrush chambers (six in this instance) will be marked in such a manner that each user will be assigned an identifiable chamber for storage of his/her toothbrush when not in use. It is estimated that the frequency of refilling base container 12 would be about once a month.

Because the level of the sanitizing solution in the base container is well above the tops of cups 18, a positive pressure assures that the fresh solution will be forced into the cylinders 12 during a refill process.

Figure 5:
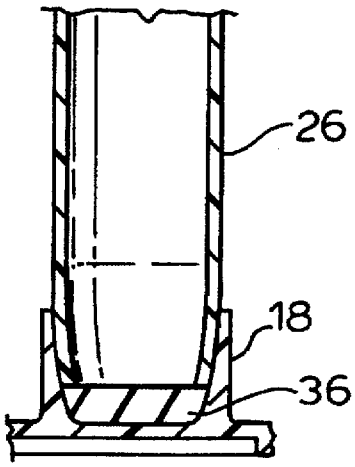
FIG. 5 is a view of an alternate form of the invention.

The device of this invention has been described and illustrated having six toothbrush storage pockets. FIG. 5 shows the inclusion of a resilient disc 18 at the lower end of cylinder 26 which is placed in cup 18 when it is desired to utilize less of the pockets than 6. Disc 36 has sufficient resilience to provide a seal between cylinder 26 and cup 18 even when thumbscrew 34 is unscrewed to disengage the cylinders 26 from their sealing position in cups 18. This prevents the sanitizing solution from entering the chamber having the resilient disc at the cylinder-cup interface, hence, prevents wasting of the sanitizing solution.

Although the device has been illustrated as being round, other shapes are possible. Similarly, the toothbrush pockets have been illustrated as being cylindrically shaped (with a slight taper). Other shapes such as oval or rectangular cross-sections may be chosen for other aesthetic values. Such departures are deemed to be obvious variants of the overall invention. While the preferred embodiment has been described herein, applicants prefer to limit the scope and interpretation of their invention by the following claims.

We claim:

1. A container for storing toothbrushes in pockets formed in said container, said container having a bowl shaped receptacle containing a predetermined amount of a sanitizing solution, and a mating lid for said receptacle, said lid having a mating surface at the periphery thereof for sealingly mating with said receptacle at the outer edge thereof, said lid having a series of toothbrush pockets formed integrally in said lid in the form of hollow open cylinders extending downwardly from said lid to contact complimentary sealing means on the lower surface of said receptacle said lid and receptacle having biasing means for urging said lid and receptacle together to cause said lid and receptacle to seal, and simultaneously cause said open cylinders to engage said complimentary sealing means to prevent the flow of sanitizing solution from said receptacles into said pockets formed by said hollow cylinders and said complimentary sealing means.

2. A container as claimed in claim 1 wherein said biasing means may be relaxed to permit said cylinders to disengage from said sealing surface to permit the sanitizing solution to flow into said pockets from said receptacle.

3. A container as claimed in claim 1 wherein said lid has a top surface which is normally convex.

4. A container as claimed in claim 3 wherein said biasing means is applied to said lid and receptacle to cause the top surface to deflect to be substantially flat.

5. A method of providing a sanitizing solution for a toothbrush pocket of a toothbrush storage device comprising:

providing a container comprising a container and a lid having toothbrush pockets descending therefrom, mounting said lid on said container so that said pockets are immersed in said sanitizing solution, energizing said storage device with a sanitizing solution, moving said storage pocket with in said device in such a manner to allow the sanitizing solution to enter the lower portion of said pocket and fill to a predetermined level, moving said storage pocket to a sealing position to seal said pocket against further ingress of said sanitizing solution.

6. A storage device for a plurality of toothbrushes, comprising a vessel having a bowl shaped container and a mating lid, each having a mating lip at the edge thereof, said lid having a series of hollow cylindraceous protrusions formed integrally with said lid and extending downwardly into said bowl shaped container such that both ends of said protrusions are open and the lower end of said protrusions are slightly tapered, a hollow central post in said lid also extending downwardly a short distance from the surface of said lid, said bowl having a series of cup shaped receptacles integrally formed in the interior of the lower surface of said bowl shaped container, said receptacles being of a size and location to mate with said downwardly extending protrusions, said cup shaped receptacles having a tapered surface to mate with the taper on the lower end of said protrusions, said container having a hollow center post arising from and integrally attached to the lower surface of said bowl shaped container, fastening means to pass through said center posts of said lid and said container to urge the lid and container into contact at the location of said mating lips to form a seal thereat, and simultaneously urge said protrusions extending from said lid into engagement with said cup shaped receptacles formed in the lower surface of said bowl shaped container to form a seal at the mating surface thereof.

* * * * *